US009255406B1

(12) United States Patent
McCary, Sr.

(10) Patent No.: US 9,255,406 B1
(45) Date of Patent: Feb. 9, 2016

(54) INSULATING AND VENTING ASSEMBLY

(71) Applicant: John Milner McCary, Sr., Birmingham, AL (US)

(72) Inventor: John Milner McCary, Sr., Birmingham, AL (US)

( * ) Notice: Subject to any disclaimer, the term of this patent is extended or adjusted under 35 U.S.C. 154(b) by 0 days.

(21) Appl. No.: 14/545,025

(22) Filed: Mar. 18, 2015

(51) Int. Cl.

| | |
|---|---|
| ***E04B 1/70*** | (2006.01) |
| ***E04C 2/34*** | (2006.01) |
| ***E04D 13/16*** | (2006.01) |
| ***E04D 13/17*** | (2006.01) |
| ***E04B 1/80*** | (2006.01) |
| ***E04B 1/76*** | (2006.01) |

(52) U.S. Cl.
CPC ..... *E04C 2/34* (2013.01); *E04B 1/7069* (2013.01); *E04B 1/7612* (2013.01); *E04B 1/80* (2013.01); *E04D 13/1618* (2013.01); *E04D 13/172* (2013.01)

(58) Field of Classification Search
CPC ..... E04B 1/80; E04B 1/7612; E04B 1/709; E04D 13/172; E04D 13/1625; E04D 13/1618; E04D 13/1726; E04C 2/34
See application file for complete search history.

(56) References Cited

U.S. PATENT DOCUMENTS

| | | | | |
|---|---|---|---|---|
| 2,330,941 | A * | 10/1943 | Acuff, Jr. | 52/407.1 |
| 4,509,307 | A * | 4/1985 | Beaudet | 52/309.4 |
| 4,875,322 | A * | 10/1989 | Rozzi | 52/746.1 |
| 5,069,950 | A * | 12/1991 | Crookston, Sr. | 428/156 |
| 8,291,660 | B2 * | 10/2012 | McCary | E04D 12/002 52/169.14 |
| 8,635,823 | B2 * | 1/2014 | McCary | E04C 2/34 52/169.14 |
| 2004/0000112 | A1 * | 1/2004 | Alderman | 52/407.3 |
| 2004/0163345 | A1 * | 8/2004 | Alderman | 52/404.1 |
| 2005/0255284 | A1 * | 11/2005 | Pritchett | 428/74 |
| 2006/0010805 | A1 * | 1/2006 | Hockman | 52/404.1 |
| 2006/0117686 | A1 * | 6/2006 | Mankell et al. | 52/302.1 |
| 2006/0123724 | A1 * | 6/2006 | Pollack | 52/302.1 |
| 2006/0179748 | A1 * | 8/2006 | Schmidt | 52/302.1 |
| 2006/0236653 | A1 * | 10/2006 | Showers | 52/794.1 |
| 2010/0095625 | A1 * | 4/2010 | Boutaghou et al. | 52/506.01 |
| 2011/0271626 | A1 * | 11/2011 | Lewis | 52/407.3 |
| 2011/0296781 | A1 * | 12/2011 | McCary | 52/309.2 |
| 2013/0199126 | A1 * | 8/2013 | McCary | 52/794.1 |

FOREIGN PATENT DOCUMENTS

DE 10010824 A1 * 9/2001

* cited by examiner

*Primary Examiner* — Adriana Figueroa
*Assistant Examiner* — Jessie Fonseca

(57) ABSTRACT

The present invention comprises an effective insulation and ventilating assembly that can insulate a structure, usually in roofing or exterior wall applications, from conductive, convective and radiant heat. The insulating and venting assembly is comprised of a rigid foam sheet and a rigid panel such as oriented strand board (OSB) or plywood attached one or both sides of the rigid foam sheet. The rigid foam sheet has air spacer columns and air spaces on one or both faces. Radiant barrier layers can be applied to either faces of the rigid panels and/or can be applied to the air spacer and air space surfaces allowing for radiant heat to be radiating back or radiant heat to not be reradiated by the radiant barrier low emissivity surface. The air spaces in the rigid foam face allows air and moisture to be vented though the insulating and venting assembly.

8 Claims, 3 Drawing Sheets

INSULATING AND VENTING ASSEMBLY

CROSS-REFERENCED TO RELATED APPLICATIONS

This application makes reference to U.S. Pat. No. 8,291,660 and U.S. Pat. No. 8,635,823.

BACKGROUND OF THE INVENTION

Roofs and walls of a building or structure must deal with various environmental and interior building factors such as heat and cold insulation, proper venting and moisture control. The design of the roof and wall systems needs to be structurally sound while providing for a habitable temperature living space. Structural Insulating Panels or SIPS and nail base panels have been used in building's roof and wall construction for many years. Customarily SIPS are constructed by having rigid foam insulation board sandwiched between plywood and oriented strand board (OSB) panels. Nail base panels are usually constructed with plywood or OSB adhered to just one side of rigid foam. Traditional SIPS are used in new building construction and nail base panels used in retrofit or remodeling structures. The rigid foam give heat and cold insulation while the plywood or OSB provides a surface for siding, roofing or other materials to be applied.

Foam insulation board is usually made up of extruded or pressed sheets made of expanded polystyrene (EPS), extended polystyrene (XPS), and polyisocyanurate (polyiso). Rigid foam board insulation provide high R-value with minimum thickness; low weight allows for easier installation and shipping cost; energy required to produce polystyrene foam insulation is 24 percent less than the energy required to make the equivalent R-value of fiberglass insulation (green product); high resistance to mold.

There are three sources of heat that affect the ability of a building structure's insulation to control heat transfer. The "insulation" or heat and cold control of the temperature controlled space may be broadened to include dealing with moisture.

Convective heat transfer is the movement of air either naturally as in where hot air rises displacing the cold air (moves the cold air down), or the mechanical convection when air is physically moved such as by a fan. Convective heat movement accounts for about 15 to 20% of heat loss/transfer (air leakage) through exterior walls.

Conductive heat is the transfer of heat energy from one object by touch to another object. Thermal bridging of solid studs in a wall is an example of conductive heat loss bridging between external face covering to interior wall covering.

Radiant heat is the absorption of radiant energy emitted by a heated object. Approximately 60 to 75% of total heat transfer in a residence or building occurs through radiation, can be as much as 90% heat gain in the attic/ceiling in the summer time.

Improper venting and moisture control can impact the ability of the wall or roof system to control heat (insulation saturation with moisture and collapse) and to maintain the structural integrity of the building (rot, decay, or insects). Moisture control and drainage in the exterior wall is critical in certain applications such as brick and stucco where there may be through face leakage.

Radiant reflective material, usually an aluminized or aluminum foil material, has been more significantly applied to many building construction material surfaces such as roof and wall sheathing, fibrous blanket and foam insulation board. The radiant reflective surface can be effective in reflecting a significant amount of radiant heat if the reflective surface faces the source of the radiant heat and there is an approximately a ¾ inch air space between the reflective surface and another surface. Conversely, if the radiant reflective surface, or sometimes called a radiant barrier, faces away from the radiated heat and there is at least a ¾ inch air space between the radiant barriers reflective surface and another object, the radiant heat will not be radiated beyond the reflective surface, the radiant barrier has a low emissivity.

But most of the radiant reflective insulation on the market today does not address one of the major requirements for an effective radiant barrier. One of the problems or inefficiencies of many of the radiant barrier applications is that when reflective surfaces of the foil engage another surface, such as the fiberglass of an adjacent insulation blanket or the adjacent gypsum foam board or other wall structure, such as siding, the radiant barrier surface loses a considerable amount, if not all, of the radiant barriers ability reflect back or not radiate radiant heat (effective low emissivity).

Another problem with the use a radiant barrier surface on combination with other insulation materials is that the surface should become dirty from an accumulation of dust, trash, fibers, vapors, etc., the reflective sheet loses its ability to reflect back or not emit radiant heat. There needs to be a protective covering spaced apart from the radiant barrier reflective surface.

SUMMARY OF THE INVENTION

Briefly described, the present invention comprises an economical and effective heat and cold insulating and venting assembly including structural insulating style panels (SIPS) and nail base style insulation assemblies that can also assist in insulating the structure from radiation heat transfer through walls, roofs or in other radiant barrier applications. The insulating and venting assembly's unique configuration either keeps radiant heat from penetrating through the roof or wall, or vents out the conduction generated heat. The SIP and nail base insulation assemblies' configurations can also be very effective in moisture venting.

The SIP style configuration and nail base insulating assembly of the application is similar to a traditional SIP and nail base insulating assembly except the rigid insulating foam is in an air and moisture venting pattern made up of columns or air spacers and open spaces between the rigid foam and the top plywood, OSB or other panel that allows air and moisture to be vented through the assembly's air spaces to the next adjoining assembly's air spaces and then able to be vented out the roof or wall.

The second embodiment of the Application invention is to have radiant barrier reflective material either applied on the surface of the rigid foam air spaces or on the underside of the panel(s) that is in contact with the air spacer columns. The spacers are also designed where a small portion of the spacer touches the reflective surface allowing the majority of the surface to effectively reflect radiant heat back upward if the radiant barrier surface is applied to the upward foam surface or not radiate radiant head downward if the radiant barrier aluminized or foil surface is placed on the interior face of the top rigid panel such as OSB, plywood or other composition panel. When the air spacers touch the radiant barrier reflective/low emissivity surface or when the radiant barrier reflective/low emissivity surface is too close to the air spacer surface, approximately ¼ inch or closer, heat is transferred by conduction from the radiant barrier reflective/low emissivity surface to the air spacer. The convective air movement within the air spaces picks up much of the conductive transferred heat and vents the heated air out the air spaces. The result is that the unique configuration of the insulating and venting assembly allows a substantial amount of radiant heat broadcast on the roof or wall is either kept above or on the roof, or exterior wall line, or conduction heat transferred to the air spacers and air space surfaces can be convectively vented through the air spaces.

The panel covering the venting foam helps protect the reflective surfaces of the reflective sheet from the accumulation of dirt, dust, insulation fiber, vapor and other things that would occlude or diminish the reflective or emissivity properties of the reflective surface of the radiant barrier.

The air spaces of the insulating and venting assembly can also be used, in conjunction with effective radiant heat reflection or low emissivity, to vent air and to allow moisture to be removed or evaporated. This can be very useful in geographic areas where there are high levels of exterior moisture and warm temperatures or in colder areas with varying interior/exterior temperatures and moisture levels. If moisture is not controlled then rot, interior wall freezing, mold, mildew and other complications can occur including reduction in insulation effectiveness. In some applications, such is in hip roofs and roof valleys, the insulating and venting assembly may have to be slightly modified or air spacer rigid foam removed to create an air space for continuous venting up or through the roof.

BRIEF DESCRIPTION OF THE INVENTION

Figure 3:
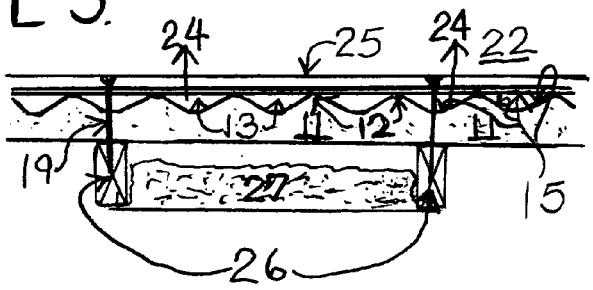

FIG. 3 demonstrates in a cross sectional view the insulating and venting assembly designed in the nail base insulating and venting assembly being applied in a wall application.

Figure 4:
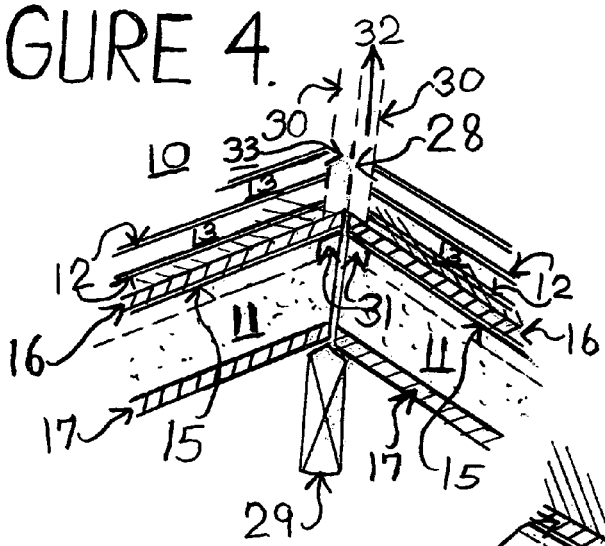

FIG. 4 shows in a perspective cross sectional view the insulating and venting assembly components in a hip roof application.

Figure 5:
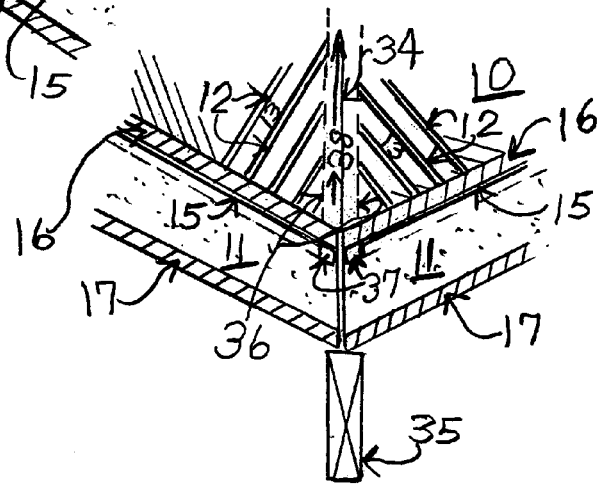

FIG. 5 shows in a perspective cross sectional view the insulating and venting assembly components in a roof valley application.

Figure 6:
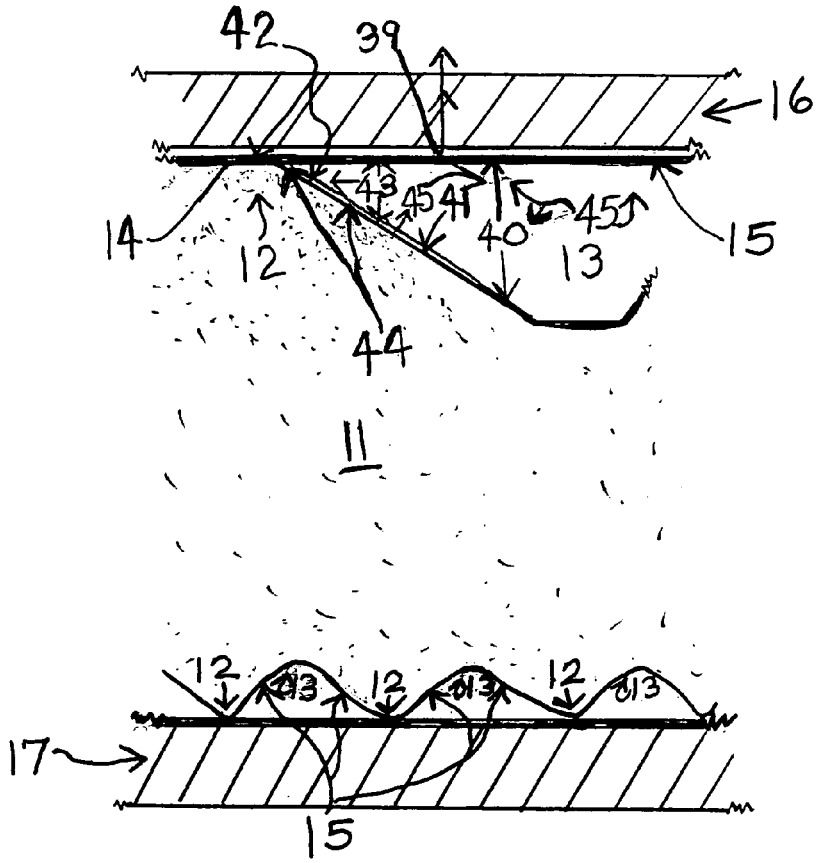

FIG. 6 demonstrates in a cross sectional view the convective flow of air through the air spaces.

DETAILED DESCRIPTION OF THE PREFERRED EMBODIMENTS

Figure 1:
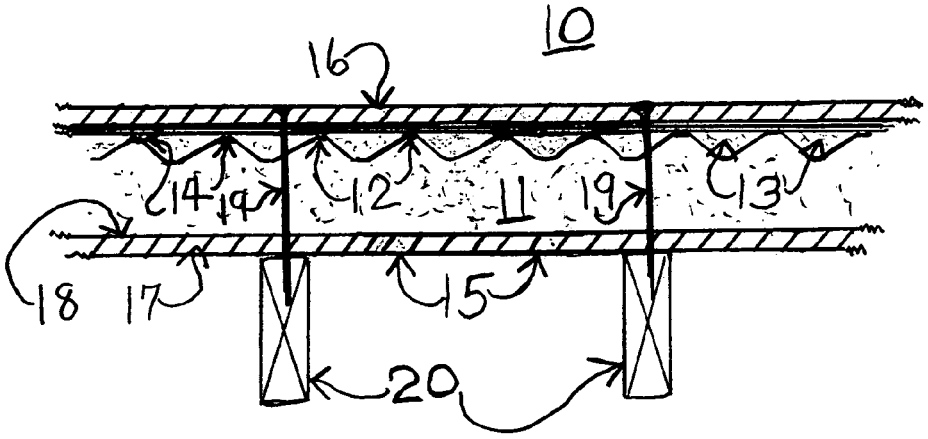
FIG. 1 shows in a cross sectional view the components of the venting and venting assembly designed in a structural insulating panel (SIP) insulating and venting assembly placed on roof rafters.

Shown in FIG. 1 in a cross sectional view is the radiant insulating and venting assembly 10 components used in a new roofing application. Shown is a rigid foam sheet 11 with the non-collapsing air spacer columns 12 and air spaces 13 between the air spacers. The outer ends of the air spacers 14 can be are attached to the radiant barrier low emissivity surface 15. The radiant barrier low emissivity surface 15 is adhered to the upper rigid board 16, or the low emissivity surface 15 can be adhered to the surface of the air spaces 13. A low emissivity surface 15 can also be attached to the lower face of the lower rigid board 17, that is attached to the lower face 18 of the rigid foam sheet 11. Nails, screws or other attaching mechanisms 19 adheres the insulating and venting assembly 10 to the roof rafters 20. Air and moisture flows 21 up through the air spaces 13.

Figure 2:
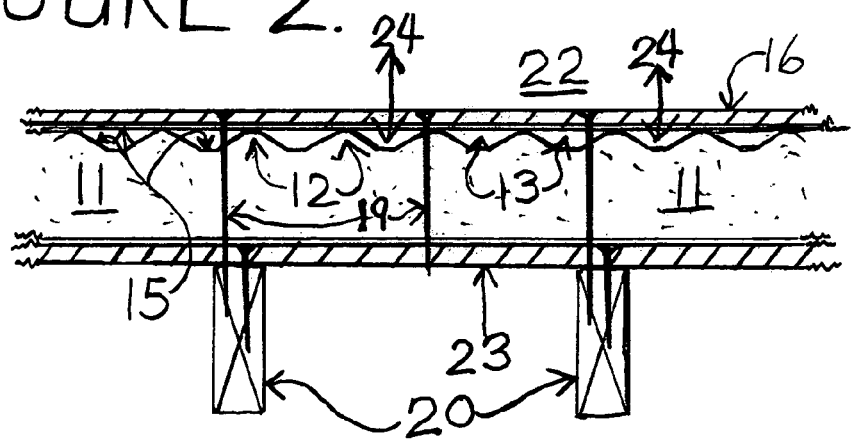
FIG. 2 shows in a cross sectional view the components of the insulating and venting assembly designed in a nail base insulating and venting assembly placed on roof sheathing reroof application.

FIG. 2 shows in a cross sectional view the insulating and venting assembly 22 used in a re-roofing or retrofit roofing application. Shown are the created air spaces 13 between the air spacers 12 formed in the rigid foam sheet 11, the radiant barrier low emissivity surface 15 adhered to the upper rigid board 16. Nails, screws or other attaching mechanisms 19 attach the reflective and venting assembly 22 to the existing re-roofed sheathing 23 and existing roof rafters 20. Here again air and moisture flow up 24 through the air spaces 13.

FIG. 3 demonstrates in a cross sectional view of the insulating and venting assembly used in a wall application. The rigid foam sheet 11 is shown with air spaces 13 and air spacer columns 12 attached to a radiant barrier low emissivity surface 15. The radiant barrier low emissivity surface is adhered to a rigid board 25. Nails, screws or other attaching mechanisms 19 adheres the insulating and venting assembly 10 to the wall studs 26. Air and moisture can flow 24 through the air spaces 13. Also shown is bat style insulation 27 added between the wall studs on the interior side of the wall.

FIG. 4 shows in a perspective cross sectional view the insulating and venting assembly 10 being applied in a hip roof application 28. Shown are two sections of insulating and venting assemblies with; rigid foam sheets 11, air spacers 12, air spaces 13, radiant barrier low emissivity surfaces 15, upper rigid board 16 and rigid panel 17, attached to a hip roof rafter 29. Shown is a cut line 30 where air spacers are cut or removed 31 to allow continuous venting up 32 the created venting space 33.

FIG. 5 shows in a perspective cross sectional view the insulating and venting assembly 10 being applied in a roof valley application 34. Shown are two sections of insulating and venting assemblies with; rigid foam sheets 11, air spacers 12, air spaces 13, radiant barrier low emissivity surfaces 15, upper rigid board 16 and lower rigid board 17, attached to a roof valley rafter 35. Shown is a cut line 36 where air spacers are cut or removed 37 to allow continuous venting up/through the created venting space 38.

FIG. 6 demonstrates in a cross sectional view the insulation and venting assembly 10. Shown is the rigid foam sheet 11, air spacer 12, air space 13, radiant barrier low emissivity surfaces 15, upper rigid board 16 and lower rigid board 17. Radiant heat is shown not being radiated through 39 the radiant barrier low emissivity surface 15 where the space 40 between the radiant barriers low emissivity surface 15 and the air spacer 12 and/or air space 13 surface 41 is approximately more than ½ inch. Conduction heat is transferred 42 from the radiant barrier low emissivity surface at the point where the air spacer out ends 14 of the air spacers touch the radiant barrier low emissivity surface or where the space 43 between the radiant barriers low emissivity surface and the air spacer is approximately less than ½ inch. The conductively generated heat 44 on the surfaces of the air spacer and/or air space is shown being convectively vented 45 through the air space 13.

The invention claimed is:

1. An insulating and venting panel assembly, comprising:

a. an insulating rigid foam sheet having heat and cold insulating capabilities, the insulating rigid foam sheet comprising a composition selected from the group consisting of expanded polystyrene, extended polystyrene, polyisocyanurate rigid foam and other insulating rigid foam material;

b. air spacers comprising non-collapsing columns that are extruded, molded or cut on an upper face of the insulating rigid foam sheet;

c. air spaces formed in between the non-collapsing columns, said air spaces having a depth of approximately ¾ to 1½ inches;

d. an upper rigid board comprising a composition selected from the group consisting of oriented strand board, plywood or other composition material;

e. a radiant barrier low emissivity surface attached to a lower face of the upper rigid board, said radiant barrier lower emissivity surface configured to reradiate a low amount of radiant heat when facing said air spaces;

f. each air spacer comprising an air spacer outer end having a width approximately ½ to 1 inch wide, each air spacer outer end facing outward from the upper face of the insulating rigid foam sheet and is attached to the radiant barrier low emissivity surface;

g. a lower rigid board comprising a composition selected from the group selected from oriented strand board, plywood or other composition material, wherein the lower rigid board is attached to a lower face of the insulating rigid foam sheet opposite a side of the rigid foam sheet that the upper rigid board is attached thereto;

h. wherein the radiant barrier low emissivity surface is attached to the insulating rigid foam sheet;

i. wherein, approximately 10 to 15 percent, of the air spacer outer ends are attached to and touching the radiant barrier low emissivity surface, configured to minimize radiant heat radiation from the radiant barrier low emissivity surface;

j. wherein heat is transferred by conduction from the radiant barrier low emissivity surface to the air spacer outer ends and/or at least one surface of the air spaces;

k. wherein said air spaces can vent air and moisture vapor, including convectively venting heated air generated from the air spacer outer ends and/or the at least one surface of the air spaces heated by conduction, to flow through said air spaces;

l. wherein, the insulating and venting panel assembly is placed on, and is configured to be attached to a top surface of roof rafters, in a roofing application, so that said air spacers attached to the radiant barrier lower emissivity surface extends away from the top surface of the roof rafters for adjoining other insulating and venting panel assemblies in the roof application, wherein the air spaces adjoin air spaces of the other insulating and venting panel assemblies, allowing for venting out air and moisture vapor from the roof; and m. wherein compression stability of the non-collapsing columns is configured to allow applied roofing materials including asphalt or fiberglass shingles, tiles, and metal roofing to be attached to the upper rigid board.

2. The insulating and venting panel assembly according to claim 1, wherein a radiant heat reflective surface is attached on a lower face of the lower rigid board.

3. The insulating and venting panel assembly according to claim 1, wherein a radiant heat reflective surface is placed on a surface of the air spacers of the rigid foam sheet that is attached the upper rigid board.

4. The insulating and venting panel assembly according to claim 1, wherein the lower face of the insulating rigid foam sheet that is attached to the lower rigid board has air spaces and air spacers attached to the lower rigid board.

5. The insulating and venting panel assembly according to claim 4, wherein a radiant barrier low emissivity surface is attached to the lower face of the lower rigid board.

6. An insulating and venting panel assembly, comprising:

a. an insulating rigid foam sheet having heat and cold insulating capabilities, the insulating rigid foam sheet (rigid foam sheet) comprising a composition selected from the group consisting of expanded polystyrene, extended polystyrene, polyisocyanurate rigid foam, and other insulating rigid foam material; and b. air spacers comprising non-collapsing columns, that are extruded, molded or cut on at least one face of the insulating rigid foam sheet; and c. air spaces formed in between the non-collapsing columns, said air spaces having a depth of approximately ¾ to 1¼ inches; and d. an upper rigid board comprising a composition selected from the group consisting of oriented strand board, plywood or other composition material; and e. a radiant barrier low emissivity surface attached to a lower face of the upper rigid board, said radiant barrier lower emissivity surface configured to reradiate a low amount of radiant heat when facing said air spaces;

f. each air spacer comprising an air spacer outer end having a width approximately ½ to 1 inch wide, each air spacer outer end facing outward from the insulating rigid foam sheet and is attached to the radiant barrier low emissivity surface;

g. the radiant barrier low emissivity surface is attached to the insulating rigid foam sheet;

h. wherein, approximately 10 to 15 percent, of the air spacer outer ends are attached to and touching the radiant barrier low emissivity surface, configured to minimize radiant heat radiation from the radiant barrier low emissivity surface;

i. wherein heat is transferred by conduction from the radiant barrier low emissivity surface to the air spacer outer ends and/or and at least one surface of the air spaces;

j. wherein said air spaces can vent air and moisture vapor, including convectively venting heated air generated from the air space outer ends and/or the at least one surface of the air spaces heated by conduction, to flow through said air spaces;

k. wherein, the insulating and venting panel assembly is placed on, and configured to be attached to roof rafters, sheathing or wall studs, adjoining other insulating and venting panel assemblies, so that said air spacers attached to the radiant barrier lower emissivity surface extends away from the roof rafters, sheathing or wall studs, wherein the air spaces adjoin air spaces of the other insulating and venting panel assemblies, allowing for venting out air and moisture vapor from a roof or wall; and l. wherein compression stability of the non-collapsing columns is configured to allow applied roofing materials including asphalt or fiberglass shingles, tiles, and metal roofing or exterior above grade wall coverings including wood siding, cement composition boards, vinyl, brick or stucco to be attached to the upper rigid board.

7. The insulating and venting assembly according to claim 6, wherein a second face of the insulating rigid foam sheet, opposite a first face of the rigid foam sheet that is attached to the upper rigid board, comprises said air spacer columns and air spaces.

8. The insulating and venting assembly according to claim 7, wherein a radiant barrier heat reflective surface is placed upon a surface of the air spaces and/or the air spacer outer ends that are on one of the first and second faces of the insulating rigid foam sheet.

* * * * *